US006666564B1

(12) United States Patent
Su

(10) Patent No.: US 6,666,564 B1
(45) Date of Patent: Dec. 23, 2003

(54) LED PEN CLIP

(76) Inventor: Chih-Tsung Su, P.O. Box No. 6-57, Chong-Ho, Taipei 235 (TW)

( * ) Notice: Subject to any disclaimer, the term of this patent is extended or adjusted under 35 U.S.C. 154(b) by 0 days.

(21) Appl. No.: 10/237,048

(22) Filed: Sep. 9, 2002

(51) Int. Cl.[7] ..... F21V 33/00; F21W 111/10
(52) U.S. Cl. ..... 362/118; 362/231; 362/234
(58) Field of Search ..... 362/118, 109, 362/231, 234

(56) References Cited

U.S. PATENT DOCUMENTS 4,799,132 A * 1/1989 Perlsweig ..... 362/118
4,812,068 A * 3/1989 Seong ..... 362/118
5,050,053 A * 9/1991 McDermott ..... 362/118
5,405,207 A * 4/1995 Zubli ..... 362/118
6,027,223 A * 2/2000 Lakey et al. ..... 362/118
6,238,119 B1 * 5/2001 Liu ..... 362/118

* cited by examiner

*Primary Examiner*—Laura K. Tso
(74) *Attorney, Agent, or Firm*—Troxell Law Office PLLC

(57) ABSTRACT

A light emitting diode (LED) pen clip is mainly assembled by an upper pen stem, a lower pen stem and a joint portion; an accommodation space inside the upper pen stem is disposed with a LED mechanism which includes a circuit board, a press key switch, a spring, one or more than one batteries and a plurality of LEDs; wherein the batteries transmit the electric power to the circuit board via the spring; the LEDs are respectively disposed on the circuit board. Pressing and switching the press key switch changes the colors of the LEDs. The present invention includes a pen clip connected to a lateral side of the pen stem. The pen clip has a plurality of holes disposed at the upper rim end for inserting the LEDs.

4 Claims, 4 Drawing Sheets

LED PEN CLIP

BACKGROUND OF THE INVENTION

1) Field of the Invention

The present invention relates to a light emitting diode (LED) pen clip, more particularly to a pen clip mounted with a plurality of LEDs capable of working as a light pen to emit light or display an incoming call to inform the user.

2) Description of the Prior Art

A light emitting diode (LED) is made of solid semiconductor elements, functions mainly for emitting and is very electricity-saving since it only consumes one-tenth of electricity needed for a traditional light bulb. Its emitting principle and structure are different from a conventional tungsten light bulb. Its advantages includes having small volume, being able to be produced in a mass, having extremely good visibility, being bumping resistant, colorful, easy to be manufactured as an extremely small or array-type elements in larger scales. LED has been popularly applied to various fields, such as light source for a press key, displaying light for an incoming call, car light, illuminating light and displaying light.

In addition, a pen is one of the indispensable stationery in our daily lives. With the development of science and technology, some of the industrials have combined small-sized LED with the pen for multiple applications. Various pens are available on the market, for examples, a pen displaying incoming calls or a light pen. However, all of those pens having light emitting portions disposed on pen stems or pen tops fail to completely satisfy the consumers' needs.

SUMMARY OF THE INVENTION

In order to solve the abovementioned problems and achieve the other effects as well as objectives, the present invention of a light emitting diode (LED) pen clip has both of the functions of displaying the incoming calls and illumination. A plurality of LEDs are disposed on a pen clip for only increasing the illuminating brightness and changing the colors, but also informing the user in time about the incoming calls.

For achieving the abovementioned objective, the present invention of a LED pen clip is mainly assembled by an upper pen stem, a lower pen stem and a joint portion; an accommodation space inside the upper pen stem is disposed with a LED mechanism which includes a circuit board, a press key switch, a spring, one or more than one batteries and a plurality of LEDs; wherein the batteries transmit the electric power to the circuit board via the spring; the LEDs are respectively disposed on the circuit board. Pressing and switching the press key switch changes the colors of the LEDs. The present invention is characterized that a pen clip is disposed on the lateral side of the pen stem and has a plurality of holes disposed at the upper rim end thereof for inserting the LEDs therein.

To enable a further understanding of the abovementioned and other objectives, the features and the advantages of the present invention, the brief description of the drawings below is followed by the detailed description of the preferred embodiment.

DETAILED DESCRIPTION OF THE PREFERRED EMBODIMENTS

Figure 1A:
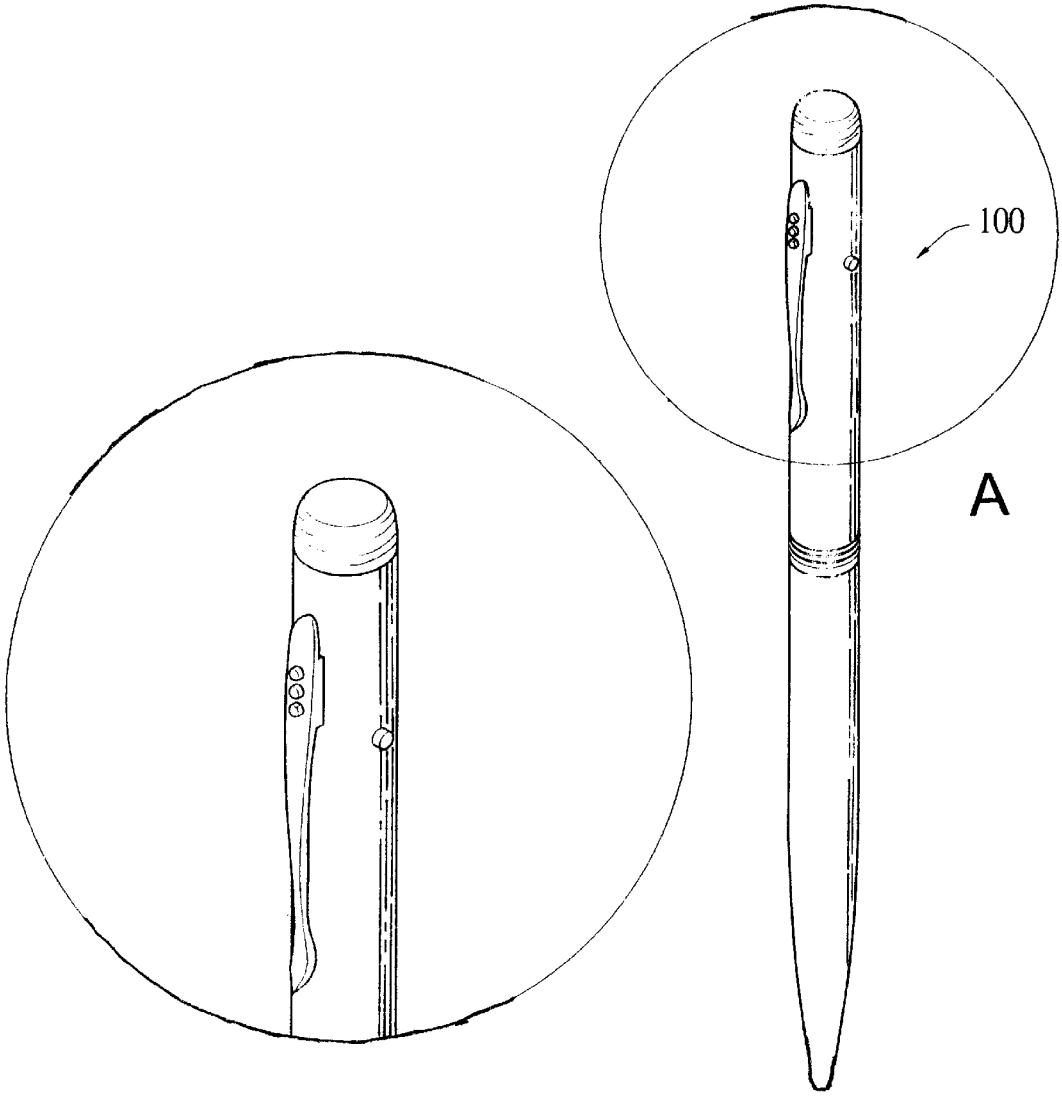
FIG. 1A is a pictorial and schematic drawing of the external view of the present invention.

FIG. 1 shows the pictorial and schematic drawing of the external view of the present invention. As indicated, the present invention has an external contour of a light pen (100) with low cost.

Figure 2:
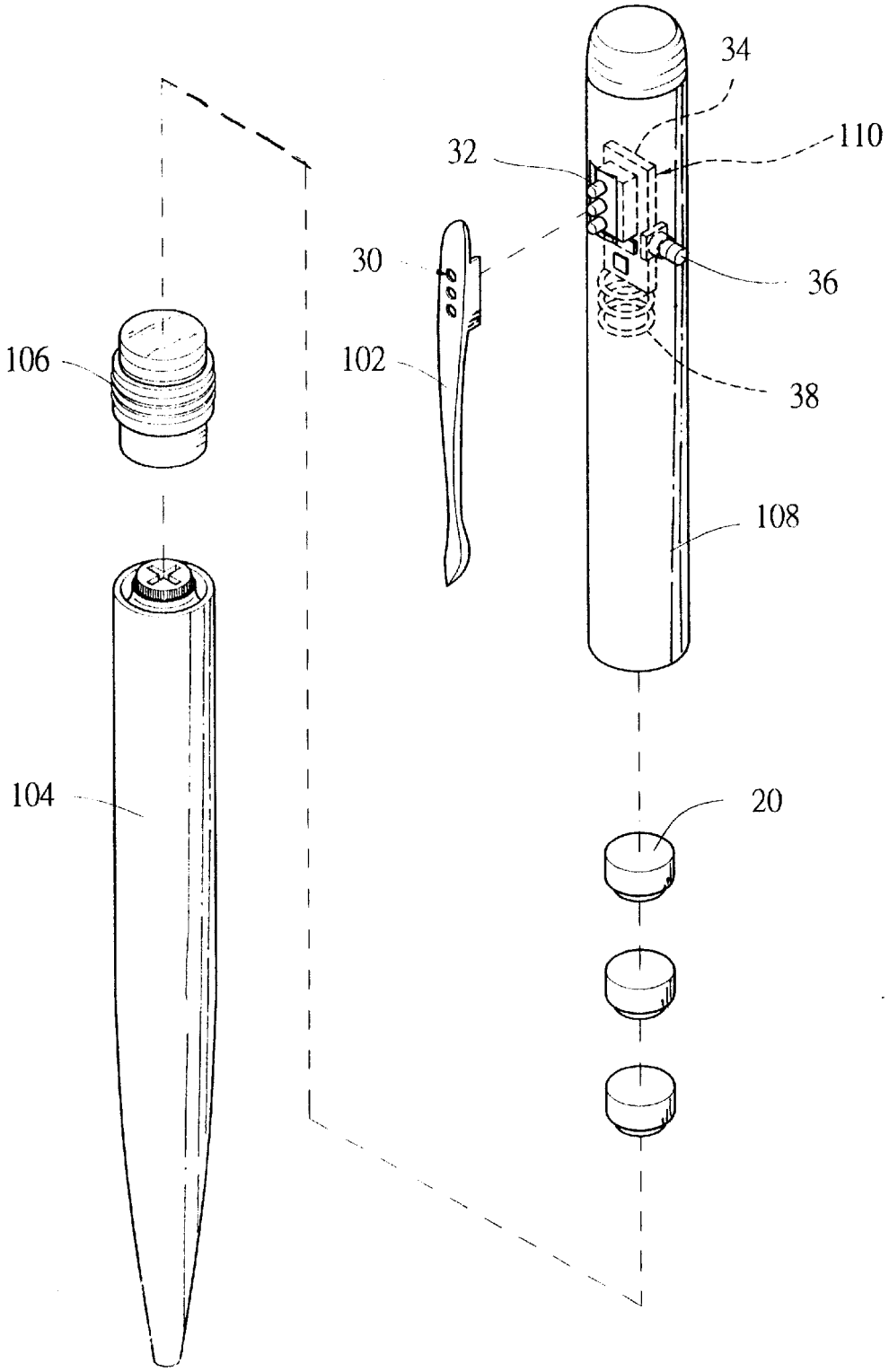
FIG. 2 is an exploded and schematic drawing of a part of the present invention.
Figure 3:
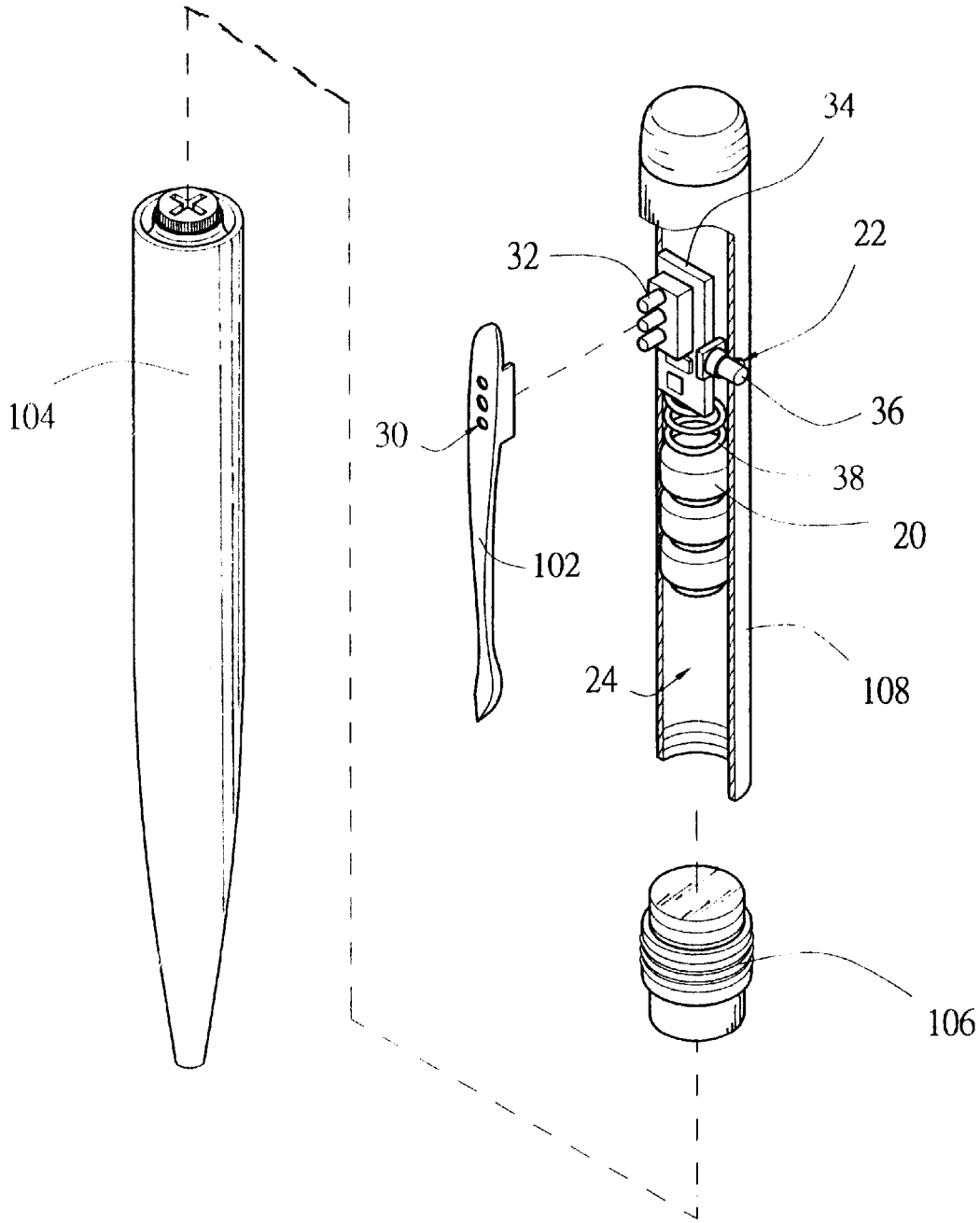
FIG. 3 is a cross-sectional and schematic drawing of a part of the present invention.

FIGS. 2 and 3 show the exploded, cross-sectional and schematic drawings of a part of the present invention. The present invention of the pen (100) is mainly assembled by an upper pen stem (108), a lower pen stem (104) and a joint portion (106); an accommodation space (24, as shown in FIG. 3) inside the upper pen stem (108) is disposed with a light emitting diode (LED) mechanism (110) which includes a circuit board (34), a press key switch (36), a spring (38), one or more than one batteries (20) and three LEDs (32); wherein the batteries (20) transmit the electric power to the circuit board (34) via the spring (38); the LEDs (32) are respectively disposed on the circuit board (34). Pressing and switching the press key switch (32) changes the colors of the LEDs (32).

The lateral side of the upper pen stem (108) is disposed with a pen clip (102) which has three holes (30) corresponding to the same number of LEDs (32) disposed at the upper rim end for inserting the LEDs (32). It is necessary to indicate that the number of the LEDs (32) and that of the disposed corresponding holes (30) are not limited to three. A circular hole (22) is disposed at the position on the upper pen stem (108) opposite the press key switch (36) for penetrating thereby facilitating a user to press and switch the colors of the LEDs (32); the colors are the primary colors of red, green and blue. It is possible to produce seven different variations of colors by the same LED (32). Multi-segmental switching of the press key switch (36) is capable of producing the effect of allowing three LEDs (32) to alternatively emit the light.

More particularly, a circuit board (not shown) is further disposed inside the circuit board (34) for displaying the incoming calls. When a certain incoming signal is received, the blink and emission of a plurality of LEDs (32) disposed on the pen clip (102) inform the user. The joint portion (106) screws the upper and lower pen stems (108, 104) together for fastening.

Figure 4:
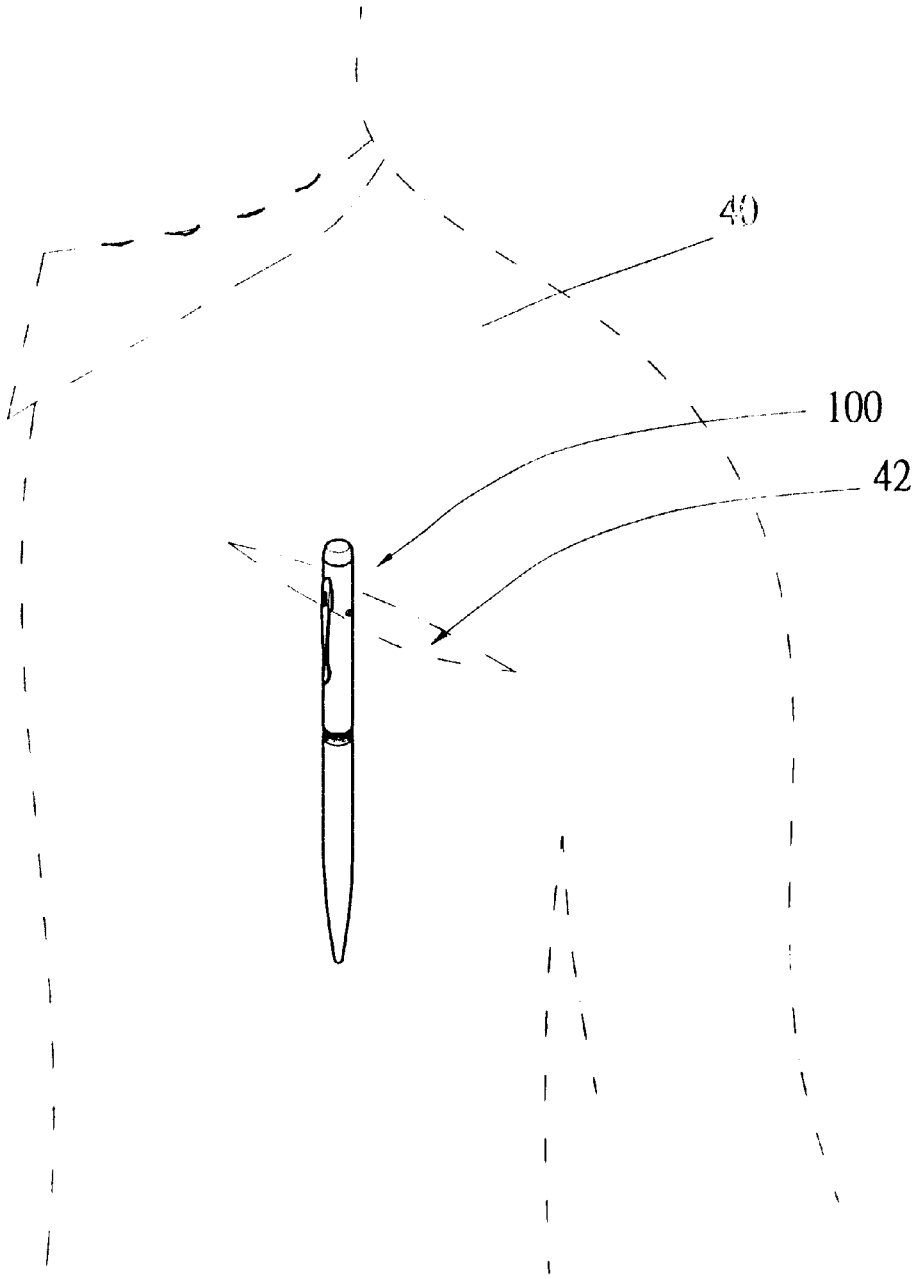
FIG. 4 is a drawing of another exemplary embodiment of the present invention in a closed state.

FIG. 4 shows another exemplary embodiment of the present invention. The present invention of the pen (100) is more convenient for being placed inside the user's (40) pocket (42) for facilitating the application, writing and emitting function. Obviously, when receiving a certain electronic signal, the LEDs (32) disposed at the upper rim area of the pen clip (102) alternatively blink and emit the light to inform the user (40) in time.

In summation of the abovementioned, the designing technique of the entire body of the present invention is not very complicate. However, the inventor, engaged in exclusively manufacturing the writing tools for years, has not yet seen any previously disclosed design with the same or similar structure. The present invention is capable of specifically achieving the beautiful, sensationally decorating and practical effects.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A light emitting diode (LED) pen clip comprising an upper pen stem, a lower pen stem and a joint portion; an accommodation space inside the upper pen stem is disposed with a LED mechanism which includes a circuit board, a press key switch, a spring, one or more than one batteries and a plurality of LEDs; wherein the batteries transmit the electric power to the circuit board via the spring; the LEDs are respectively disposed on the circuit board; pressing and switching the press key switch changes the colors of the LEDs; wherein a pen clip is disposed on a lateral side of the pen stem and has a plurality of holes disposed at the upper rim end thereof for inserting the LEDs therein.

2. The LED pen clip according to claim 1, wherein there are three LEDs.

3. The LED pen clip according to claim 1, wherein there are three holes.

4. The LED pen clip according to claim 1, wherein the joint portion screws the upper and the lower pen stems for fastening.

* * * * *